United States Patent [19]

Wilburn et al.

[11] 4,117,774

[45] Oct. 3, 1978

[54] EGG SHELLER

[76] Inventors: Everett R. Wilburn, 1847 Princeton Dr., Toledo, Ohio 43614; James A. Sorter, 6125 Windamar Rd., Toledo, Ohio 43611

[21] Appl. No.: 781,211

[22] Filed: Mar. 25, 1977

[51] Int. Cl.[2] ..... A47J 43/00

[52] U.S. Cl. ..... 99/568; 30/120.1; 239/271

[58] Field of Search ..... 99/498, 516, 532, 536, 99/568; 30/120.1; 239/271; 401/11, 25

[56] References Cited

U.S. PATENT DOCUMENTS

| | | | |
|---|---|---|---|
| 1,618,682 | 2/1927 | Snapp | 99/568 |
| 2,466,310 | 4/1949 | Gaylor | 99/568 |
| 2,506,073 | 5/1950 | Duzmal | 99/568 |

*Primary Examiner*—Harvey C. Hornsby
*Assistant Examiner*—Robert Pons
*Attorney, Agent, or Firm*—Donald R. Fraser

[57] ABSTRACT

An apparatus for removing the shell of a hard boiled egg having a main body portion in the general configuration of an egg and having a thin wedge gently shaped leading edge for insertion between the cooked egg white and the surrounding membrane and shell. A number of fluid outlets are disposed in the leading edge and are adapted to communicate with a source of pressure fluid. And valve means are disposed between the outlets and the source of pressure fluid for admitting pressure fluid to the outlets for injecting the fluid between the cooked egg white and the adjacent membrane and shell to effectively separate the membrane and shell from the cooked egg white.

5 Claims, 4 Drawing Figures

EGG SHELLER

PRIOR ART

Prior art apparatus has been designed to achieve certain of the objectives of this invention, but in many instances have been cumbersome, complex, expensive to manufacture, and somewhat complicated to use.

SUMMARY OF THE INVENTION

It is a primary object of the invention to produce an apparatus which will efficiently and sanitarily remove the shell of a hard boiled egg after the egg shell has been initially cracked or broken.

Another object of the invention is to produce an apparatus for effectively removing the shell of a previously cooked egg by means of pressure fluid such as water from the conventional kitchen sink faucet.

Still another object of the invention is to produce an apparatus for removing the shell from a hard boiled egg which can be readily connected to a source of household water supply and utilized to remove the shell and then easily disconnected upon completion.

Yet another object of the invention is to produce an apparatus utilizing water pressure to remove the shell of a hard boiled egg after the shell has been initially broken which is simple and economical to manufacture and readily adaptable to all municipal water outlet faucets.

The above, as well as other objects of the invention, may be readily achieved by an apparatus for removing the shell from a cracked hard boiled egg wherein the apparatus comprises a main body portion having a major surface thereof formed in the general configuration of a portion of the outer peripheral surface of an egg, the main body portion having a wedged shaped cross section and terminating in a relatively thin leading edge; a number of fluid outlets in the leading edge; passageway means providing communication between the outlets and a source of pressure fluid through the main body portion; and valve means in the passageway means for controlling the flow of fluid therethrough.

BRIEF DESCRIPTION OF THE DRAWINGS

The above objects and advantages of the invention will be readily apparent to one skilled in the art from reading the following detailed description of an embodiment of the invention when considered in the light of the accompanying drawings, in which.

DETAILED DESCRIPTION OF AN EMBODIMENT OF THE INVENTION

Figure 1:
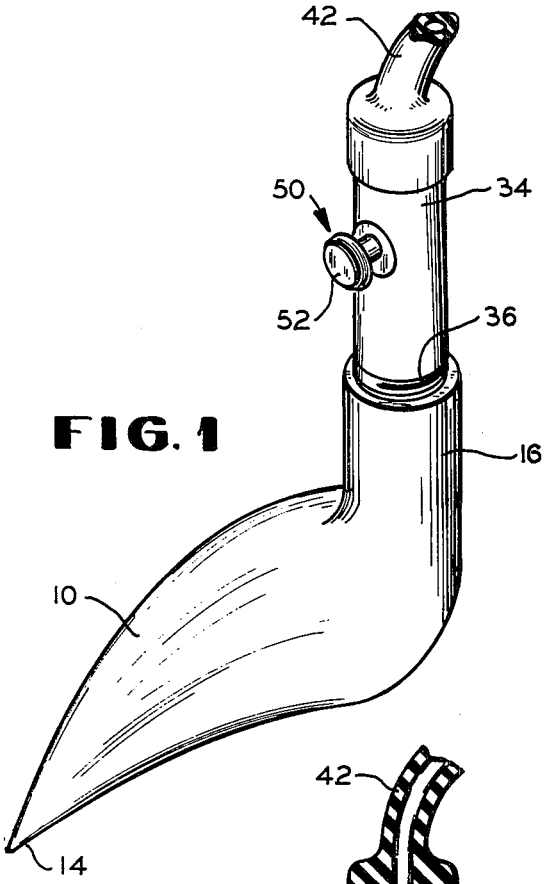
FIG. 1 is a perspective view of an egg sheller apparatus constructed in accordance with the teachings of the present invention.
Figure 2:
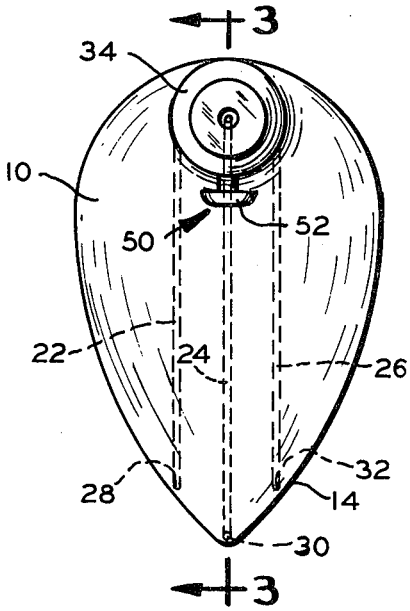
FIG. 2 is a top plan view of the structure illustrated in FIG. 1.
Figure 3:
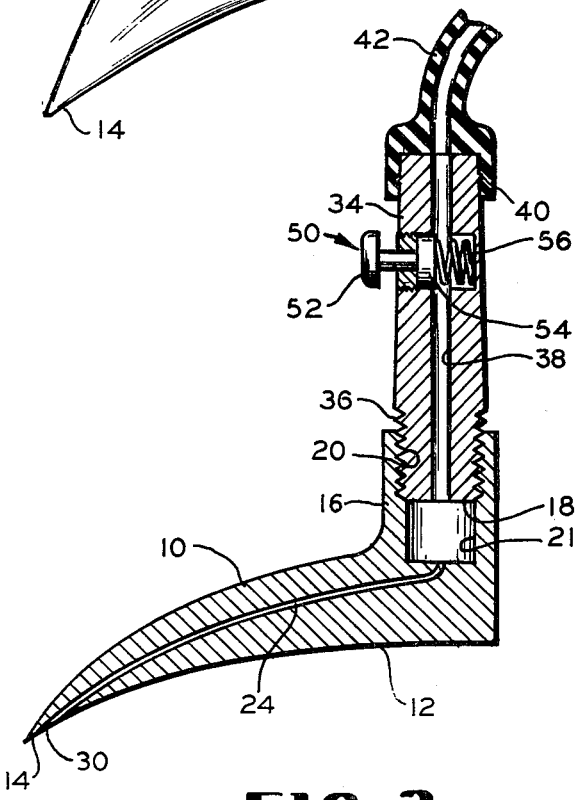
FIG. 3 is a sectional view of the structure taken along line 3—3 of FIG. 1.
Figure 4:
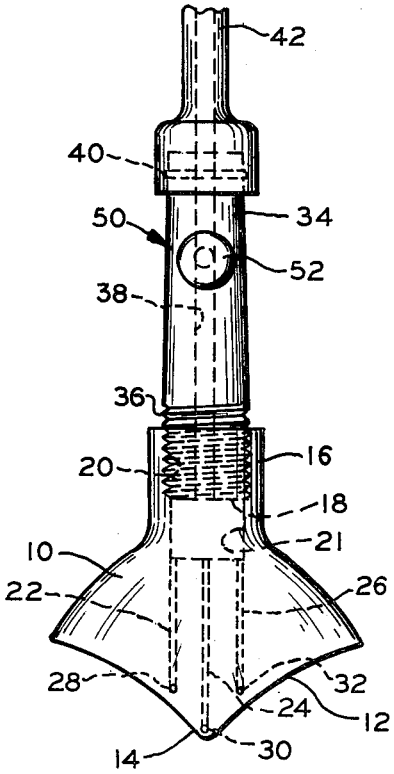
FIG. 4 is a front view of the apparatus illustrated in FIGS. 1 through 3.

Referring to the drawings, there is illustrated an egg sheller apparatus including a main body portion 10 having a bottom surface 12 formed of a somewhat concave configuration generally conforming to the shape of the outer peripheral surface of a conventional chicken egg. The main body portion 10 has a leading edge 14 which is wedge-shaped in cross-section as clearly illustrated in FIG. 3. The leading edge 14 is formed of a thin dimension so that it may be readily inserted between the cooked egg white and the adjacent membrane and shell of an egg as will become apparent from the description of the operation of the apparatus.

The main body 10 has an upstanding generally cylindrical section 16 which terminates in recess 18 having an internally threaded side wall 20. An internally formed passageway 21 extends from the base of the recess 18 and is adapted to communicate with a series of smaller passageways 22, 24, and 26, which, in turn, terminates in outlets 28, 30, and 32, respectively in the leading edge 14 of the main body 10.

A tubular sleeve 34 having an externally threaded end portion 36 is threadably received by the threaded side wall 20 of the recess 18 of the cylindrical section 16. The sleeve 34 has a central passageway 38 which at its lower end is adapted to communicate with the passageway 21 of the main body. The upper end of the sleeve 34 may be provided with an annular bead 40 or the like to form a fluid-tight coupling with the interior of one end of a rubber hose 42, for example. The other end of the rubber hose 42 is typically coupled to a source of pressure fluid, such as for example, the faucet of a conventional household water system.

In order to facilitate the on-off operation of the fluid system, a valve assembly 50 is provided in the sleeve 34. The valve 50 is normally opened and may be closed to prevent the flow of fluid therethrough by actuating the button 52, on the outer surface of the valve assembly 50. The button 52 typically seats the valve seat 54 against the bias of an associated spring 56. So long as the button 52 is depressed, fluid is prevented from flowing within the system.

In operation, the hose 42 together with the main body 10 and the sleeve 34, are attached to a faucet and then the shell of a hard boiled egg is thoroughly cracked and positioned generally beneath the main body 10 allowing the upper cracked surface of the egg to be brought into snug engagement with the concave undersurface 12. Simultaneously, the thin leading edge 14 of the main body 10 is caused to be urged to a position between the outer surface of the relatively firm cooked egg white and the membrane adjacent the inner surface of the egg shell.

At this point, the fluid outlets 28, 30 and 32 are disposed between between the outer surface of the cooked egg white and the membrane and the egg shell. The valve button 52 is then allowed to unseat by removing any pressure on the button 52, allowing the valve seat 54 to move to the position illustrated in FIG. 3 by the bias of the spring 56 which allows fluid to flow under pressure through the hose 42, sleeve 34, passageway 21, and thence into the space between the egg white and the membrane and shell through the outlets 28, 30, and 32 of the passageways 22, 24 and 26, respectively. The fluid pressure will then quickly and sanitarily remove the egg shell and membrane, leaving a clean and exposed egg white ready to be eaten or prepared for eventual eating.

After the egg shell is then completely removed from the cooked interior of the egg, the valve button 52 is returned to its closed position allowing the valve seat 54 to seat to thereby stop the further flow of the fluid through the outlets 28, 30 and 32. The apparatus may be then set up for an additional egg shelling operation or may be disconnected and stored for later use.

While the description and drawings have eluded to three outlets in the main body portion 10, it must be understood that the number is not regarded as being critical and may be effective with a greater or lesser number than three. Also, it will be understood that a number of different types of the valve structures may be utilized without departing from the spirit of the invention.

It is contemplated that the preferred material for forming the main body portion 10 is a pliable elastomeric composition such as a polyvinyl chloride. However, other materials may be utilized without adversely affecting the overall operativeness of the apparatus.

What is claimed is:

1. An apparatus for removing the shell from a previously cooked egg comprising a main body portion having a major surface thereof formed in the general configuration of a portion of the outer peripheral surface of an egg and terminating in a relatively thin leading edge for; insertion between a cracked egg shell and the cooked egg white;

fluid outlet means in the leading edge of said main body portion;

fluid passageway means providing communication between said outlet means and a source of pressure fluid; and valve means in said passageway means for controlling the flow of fluid therethrough, whereby when pressure fluid is released through said outlet means the egg shell is removed from the associated cooked egg white.

2. The invention defined in claim 1 wherein said main body portion is formed of a pliable material.

3. The invention defined in claim 2 wherein said pliable material is plastic.

4. The invention defined in claim 1 wherein said valve means is a normally open spring biassed valve.

5. The invention defined in claim 1 wherein said fluid passageway includes a flexible hose connected to a faucet.

* * * * *